US012280291B1

(12) United States Patent
Smith

(10) Patent No.: US 12,280,291 B1
(45) Date of Patent: Apr. 22, 2025

(54) MULTI-FUNCTION COLLAPSIBLE EXERCISE APPARATUS

(71) Applicant: Alfred Sidney Smith, Sammamish, WA (US)

(72) Inventor: Alfred Sidney Smith, Sammamish, WA (US)

( * ) Notice: Subject to any disclaimer, the term of this patent is extended or adjusted under 35 U.S.C. 154(b) by 21 days.

(21) Appl. No.: 18/208,434

(22) Filed: Jun. 12, 2023

Related U.S. Application Data

(62) Division of application No. 17/325,533, filed on May 20, 2021, now Pat. No. 11,701,543.

(60) Provisional application No. 63/028,503, filed on May 21, 2020.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/072*** | (2006.01) |
| ***A63B 21/078*** | (2006.01) |

(52) U.S. Cl.
CPC ..... *A63B 21/4033* (2015.10); *A63B 21/0442* (2013.01); *A63B 21/0552* (2013.01); *A63B 21/0724* (2013.01); *A63B 21/078* (2013.01); *A63B 2210/50* (2013.01); *A63B 2225/09* (2013.01)

(58) Field of Classification Search
CPC ..... A63B 21/4033; A63B 21/0442; A63B 21/0552; A63B 21/0724; A63B 21/078; A63B 2210/50; A63B 2225/09
See application file for complete search history.

(56) References Cited

U.S. PATENT DOCUMENTS 2,632,645 A * 3/1953 Barkschat ..... A63B 21/0628 482/41
3,738,649 A * 6/1973 Miller ..... A63B 21/04 482/130
3,874,657 A * 4/1975 Niebojewski ..... A63B 17/00 482/142
4,254,949 A * 3/1981 Brentham ..... A63B 21/4047 482/112
4,477,070 A * 10/1984 Appelbaum ..... A63B 69/0035 482/28
4,657,242 A * 4/1987 Guridi ..... F16B 7/22 482/40

(Continued)

*Primary Examiner* — Megan Anderson
*Assistant Examiner* — Andrew M Kobylarz
(74) *Attorney, Agent, or Firm* — QuickPatents; Kevin Prince

(57) ABSTRACT

An exercise apparatus for a person to exercise on a support surface includes two side frames that each include a base member, and a front member and a rear member each pivotally attached to the base member. Each side frame is aligned and mutually fixed together at a rear support member joining the rear members and at a front support member joining the front members. Two barbell support members each have a hook at an upper end thereof for supporting a barbell, and are fixed upright on the base members. The exercise apparatus can be configured into a collapsed configuration, circular weights of the barbell acting as wheels while the person grasps and lifts the front sides of the base members. As such the person is able to wheel the exercise apparatus along the support surface. The exercise apparatus may then be reconfigured into an expanded configuration for use.

8 Claims, 13 Drawing Sheets

(56) References Cited

U.S. PATENT DOCUMENTS

| | | | | | |
|---|---|---|---|---|---|
| 4,976,428 | A * | 12/1990 | Ghazi | A63B 23/03525 | 482/904 |
| 5,002,271 | A * | 3/1991 | Gonzales | A63B 23/0494 | 482/130 |
| 5,046,722 | A * | 9/1991 | Antoon | A63B 17/00 | 482/41 |
| 5,662,556 | A * | 9/1997 | Gangloff | A63B 1/005 | 482/17 |
| 11,033,794 | B2 * | 6/2021 | Tsai | A63B 22/0664 | |
| 2016/0074698 | A1 * | 3/2016 | Figueroa | A47C 17/38 | 5/2.1 |
| 2019/0166993 | A1 * | 6/2019 | Siaperas | A47B 81/00 | |
| 2023/0001262 | A1 * | 1/2023 | Hararri | A63B 1/005 | |

* cited by examiner

MULTI-FUNCTION COLLAPSIBLE EXERCISE APPARATUS

CROSS-REFERENCE TO RELATED APPLICATIONS

This application is a Divisional of U.S. Utility patent Ser. No. 17/325,533, filed on May 20, 2021, which itself claims the benefit of U.S. Patent Application 63/028,503, filed on May 21, 2020, both applications being incorporated herein by reference.

STATEMENT REGARDING FEDERALLY SPONSORED RESEARCH AND DEVELOPMENT

Not Applicable.

FIELD OF THE INVENTION

This invention relates to exercise equipment, and more particularly to a multi-function collapsible exercise apparatus.

BACKGROUND

Home-based exercise machines are often bulky and require a considerable amount of floor space. Further, often such exercise machines are difficult to move and store, and as such are usually left in place in a guest room or the like even when not in use. Further, often such machines are significantly limited in the number of exercises that can be performed, requiring additional exercise machines or equipment to obtain a full body workout.

Therefore, there is a need for an exercise device that is easily configurable from a collapsed configuration into a fully deployed expanded configuration. Such a needed invention would facilitate moving the apparatus easily along a floor surface when in the collapsed configuration, and would not damage wood or other flooring. Such a needed device would provide for a wide variety of exercises, and would also work with additional accessories that themselves are easily stored with the device when in the collapsed position. The present invention accomplishes these objectives.

SUMMARY OF THE INVENTION

The present device is an exercise apparatus of a person to exercise on a support surface, such as a floor. Existing accessories such as a barbell, circular weights, resistance bands, and the like, may be used with the exercise apparatus, or in some embodiments may be included with the exercise apparatus.

Two side frames each include a base member, a rear member pivotally attached to a first pivot mechanism proximate a rear side of the base member, and a front member pivotally attached at a second pivot mechanism proximate a front side of the base member. Each side frame is aligned and mutually fixed together at a rear support member joining the rear members, and at a front support member joining the front members. The front support member includes a front platform rotationally captured between the front members, and the rear support member has a rear platform rotationally capture between the rear members.

Each base member, rear member, and front member are preferably formed with a rigid, perforated square metal tube material having a plurality of longitudinally-aligned equally-spaced apertures formed along each side thereof. Preferably each first pivot mechanism further includes an angle brace having opposing ends that are each fixable with either one of the base members or one of the rear members to secure the rear members in a fixed angular relationship with the base member. Each first pivot mechanism includes an aperture engagement mechanism, such as a bolt and nut arrangement, or a bolt with a knob for manually tightening and loosening the aperture engagement mechanism.

Each second pivot mechanism includes a sleeve formed with the perforated square metal tube material, the sleeve adapted to fit over and slide along one of the base members, such that the position of the front support member may be adjusted along any of the base members and mutually secured with one of the aperture engagement mechanisms.

In use, with the base members resting on the support surface, the person can adjust: 1) the position of the front members and the front support member along the base members, 2) an angle of the front members, 3) an angle of the front support member, and 4) an angle of the rear support member while performing exercises.

Preferably the exercise apparatus further includes two barbell support members each formed with the perforated square metal tube material. Each barbell support member includes a hook at an upper end thereof, and at a lower end a third-pivot mechanisms that includes a sleeve formed with the perforated square metal tube material and adapted to fit over and slide along one of the base members between the rear member and the front member. Preferably each hook further includes a locking arrangement for locking the barbell to the barbell support member.

Each third pivot mechanism and preferably each first pivot mechanism and second pivot mechanism further includes a pair of riser plates that are adapted for pivotally engaging the lower end of one of the barbell support members. A pivot aperture in each riser plate is engaged with one of the aperture engagement mechanisms to rotationally fix each riser plate with the barbell support member. Position apertures are located at varying rotational positions from the pivot aperture to allow the barbell support member to be positioned at one of several fixed rotational positions by use of one of the aperture engagement mechanisms, the distance between the pivot aperture and each position aperture being identical and aligned with two of the apertures of the perforated square metal tube material of the barbell support member.

As such, each of the two barbell support members can be fixed upright with one of the third pivot mechanisms, both of the third pivot mechanisms being mutually aligned on each base member, such that the barbell can be supported on the hooks of the upper end of the barbell support members. One or more of the aperture engagement mechanisms locks each of the third pivot mechanisms with the base member.

In preferred embodiments of the invention, at least one resistance band anchor is further included and fixable through any of the opposing apertures of the base members, rear members or forward members. Such a resistance band anchor includes a rigid ring 9 through which a distal end of a resistance band may be fixed, either directly or with a hook, carabiner, or the like. Such a resistance band may include a resistance band loop fixed with the resistance band anchor that is adapted to be fixed in any of the opposing apertures of any of the rear members, base members, or front members.

In some embodiments the barbell has two opposing resistance band attachment rings fixed therewith. As such, one of the resistance bands may be fixed at a proximal end thereof to the barbell and at the distal end thereof to the at least one resistance band anchor, such that the person can lift the barbell to stretch the resistance bands.

Preferably each rear member includes a barbell lock that is selectively lockable to the barbell. As such, the exercise apparatus can be configured into a collapsed configuration with the base members, rear members, and front members collapsed and aligned. With the barbell fixed with the barbell lock and the exercise apparatus in the collapsed configuration, the circular weights may be fixed with each end of the barbell to act as wheels while the person grasps and lifts the front sides of the base members. The weights may include an elastomeric protective covering around a circumference thereof to minimize damage between contact of the weights and the support surface. As such the person is able to wheel the exercise apparatus along the support surface. Once positioned at a desired location on the support surface, the exercise apparatus may be reconfigured into an expanded configuration for use.

The rear support member may be configured for the person to exercise therewith utilizing a support structure such as a vertical wall. A frame of the rear support member defines an internal volume between a plurality of frame members. A front cover and a rear cover are both adapted for fixing with the frame with a plurality of mechanical fasteners that are fixed through the frame members. A handle may be fixed with the frame, such that the person can carry the rear support member by the handle.

Two or more support bar mounts are fixable to the rear cover and have apertures therein for rotationally connecting with one or more support bars attached with the support structure. The one or more support bars terminate at a wall mounting bracket, whereby the rear support member may be fixed between two vertical walls as the support structure. Alternately, the one or more support bars terminate at pivot mounts, whereby the rear support member may be fixed between two rear members as the support structure.

In another embodiment, the exercise apparatus includes the two side frames each terminating at a lower end and an upper end. Each side frame includes a spring fixed at an upper end thereof to one of the apertures of the side frame and terminating at a lower end with a foot pedal assembly. Each side frame includes at the lower end thereof a guide post, the foot pedal assembly slidably affixed to the guide post. A lower end of the guide post is fixed with a cross bar assembly supported on the horizontal support surface. Each foot pedal assembly is slidable between a raised position and a lowered position. The guide post is preferably cylindrical such that the foot pedal assembly is free to rotate around the guide post. Each side frame further includes at the upper end thereof a vertical support mount adapted for fixing with the vertical support, such as the wall or the door.

A handlebar arrangement is fixed with each of the side frames and include two handlebars projecting away from the vertical support surface between the upper end and the lower end of each side frame. As such, with the person standing on each of the foot pedal assemblies, the person can grasp the handlebars and press the foot pedal assemblies downward to expand the coil springs to perform exercises.

In some embodiments, the vertical support mounts terminate at the door hook for supporting the exercise device on the door. In other embodiments, a pair of wall mount members are fixed with the vertical support surface, each wall mount member being formed from the perforated square metal tube material having the plurality of longitudinally-aligned equally-spaced apertures formed along each side thereof. The vertical support mounts are adapted to be selectively fixed with the wall mount members at any of the apertures of the wall mount members so as to provide for a vertical adjustment of a height of the upper ends of the side frames. An angle of the side frames with respect to the vertical support surface is also adjusted thereby, typically with the removable and selectively attachable aperture engagement mechanisms.

The present invention is an exercise device that is easily configurable from a collapsed configuration into a fully deployed expanded configuration. The present device facilitates moving the apparatus easily along a floor surface when in the collapsed configuration, and does not damage wood or other flooring. The present invention provides for the person to perform a wide variety of exercises, and also works with additional accessories that themselves are easily stored with the device when in the collapsed position. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
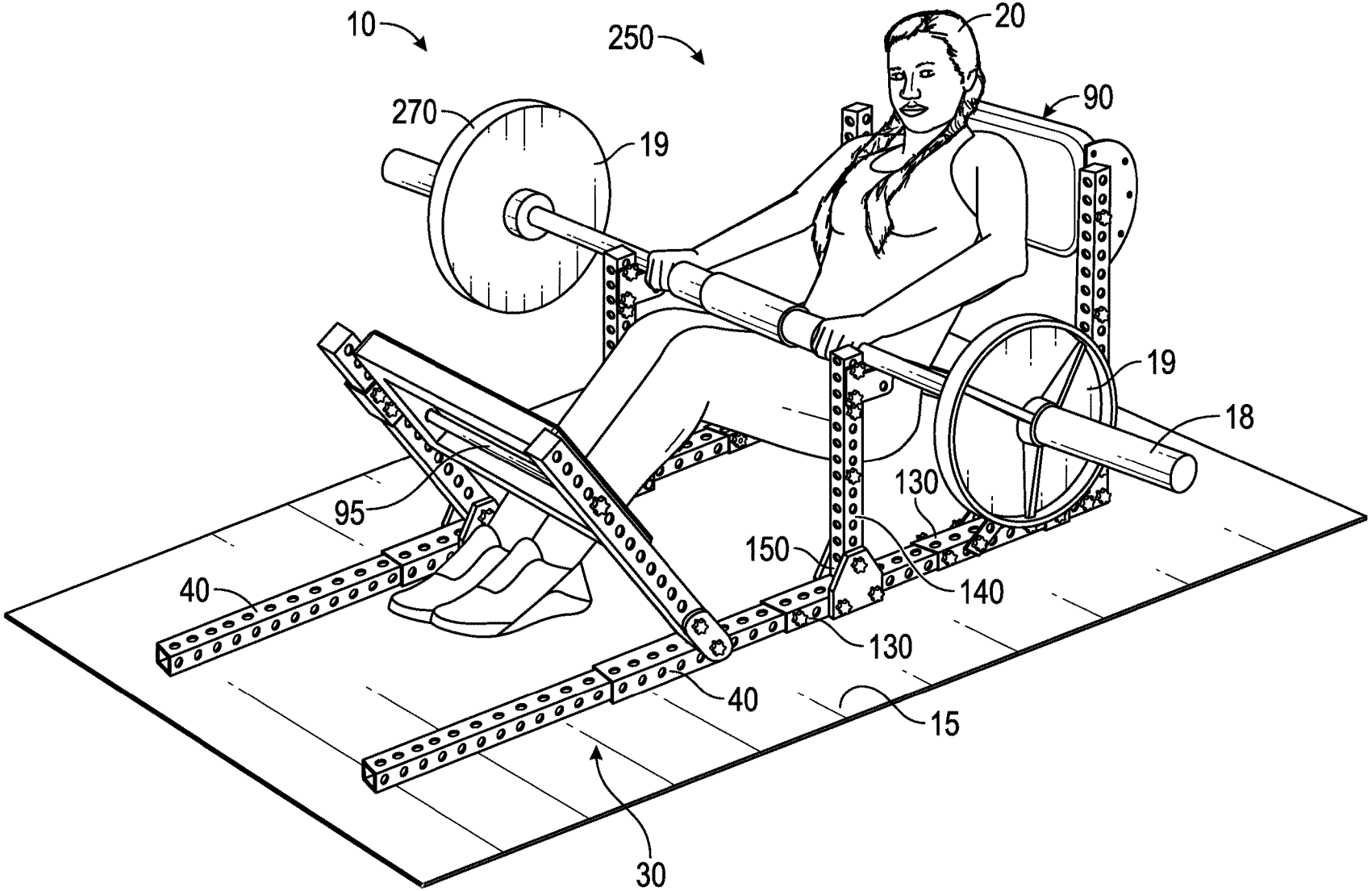
FIG. 1 is a perspective view of the invention, illustrated as used with a barbell and circular weights.
Figure 2:
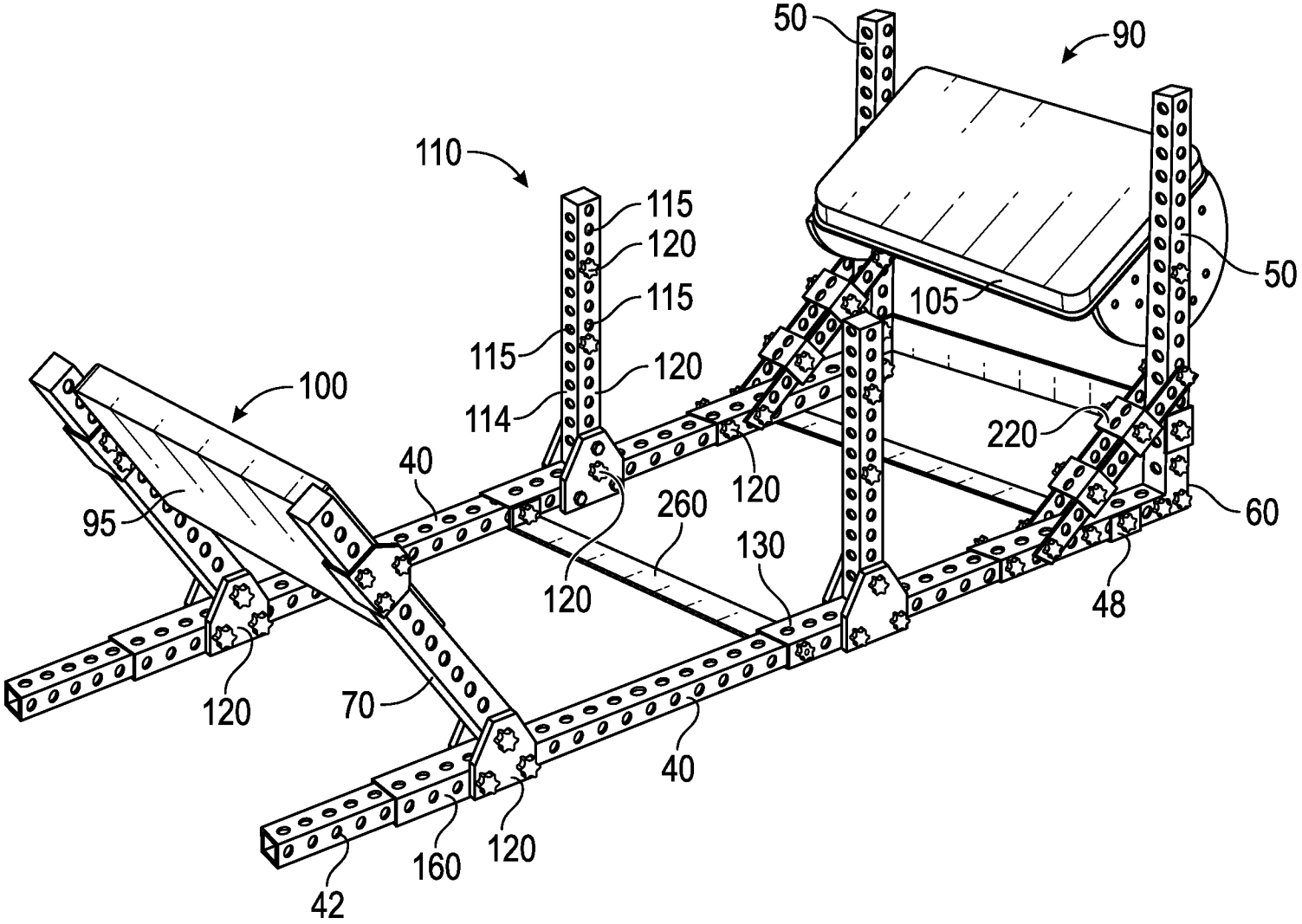
FIG. 2 is an alternate perspective view of the invention.
Figure 3:
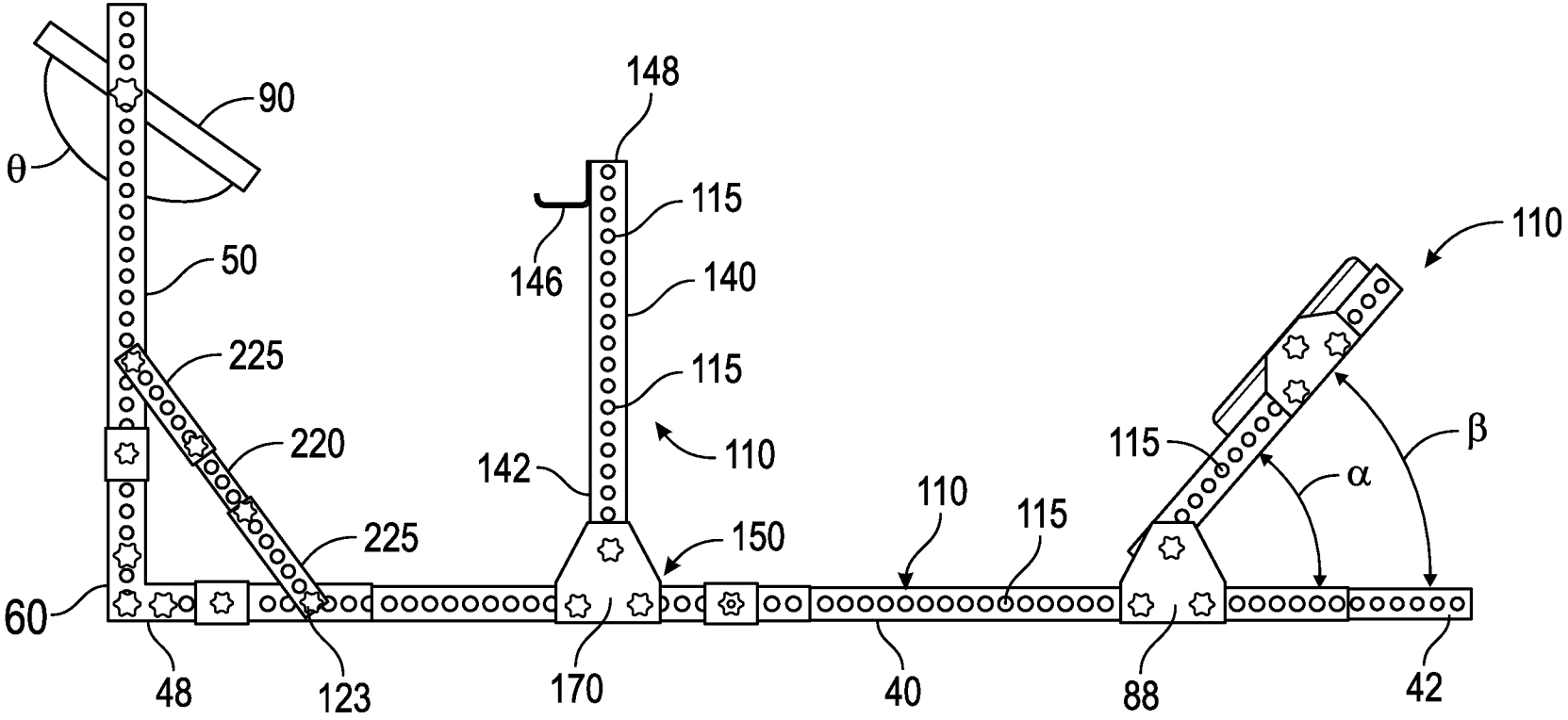
FIG. 3 is a side elevational view of the invention.

FIGS. 1-3 illustrate an exercise apparatus 10 of a person 20 to exercise on a support surface 15, such as a floor. Existing accessories such as a barbell 18, circular weights 19, resistance bands 200, and the like, may be used with the exercise apparatus 10, or in some embodiments may be included with the exercise apparatus 10.

Two side frames 30 each include a base member 40, a rear member 50 pivotally attached to a first pivot mechanism 60 proximate a rear side 48 of the base member 40, and a front member 70 pivotally attached at a second pivot mechanism 80 proximate a front side 42 of the base member 40. Each side frame 30 is aligned and mutually fixed together at a rear support member 90 joining the rear members 50, and at a front support member 100 joining the front members 70. The front support member 70 includes a front platform 105 rotationally captured between the front members 90, and the rear support member 90 has a rear platform 95 rotationally capture between the rear members 50.

Each base member 40, rear member 50, and front member 70 are preferably formed with a rigid, perforated square metal tube material 110 having a plurality of longitudinally-aligned equally-spaced apertures 115 formed along each side 114 thereof. Preferably each first pivot mechanism 60 further includes an angle brace 220 having opposing ends 225 that are each fixable with either one of the base members 40 or one of the rear members 50 to secure the rear members 50 in a fixed angular relationship with the base member 40.

Figure 4:
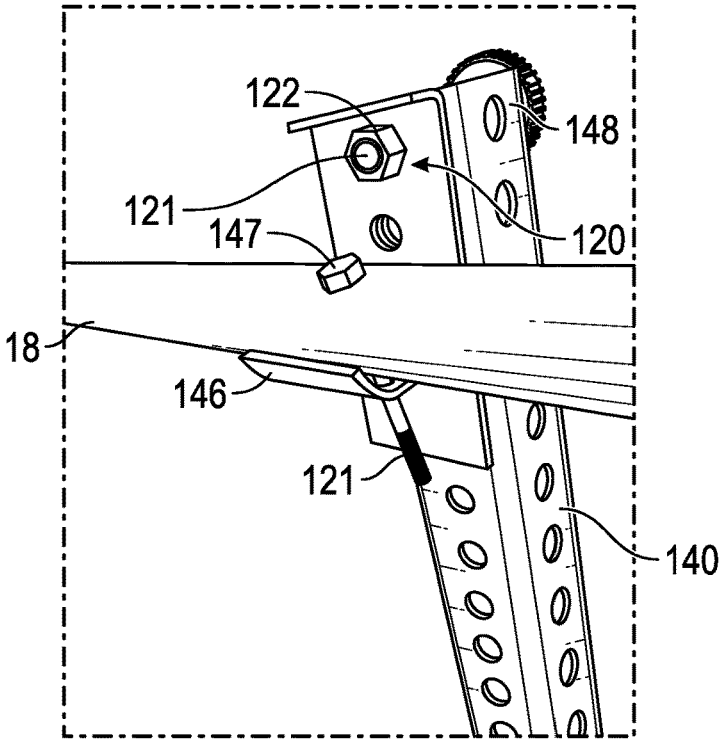
FIG. 4 is a partial, enlarged perspective view of a barbell hook and a locking arrangement therefore.

Each first pivot mechanism 60 includes an aperture engagement mechanism 120, such as a bolt 121 and nut 122 arrangement (FIG. 4), or a bolt 121 with a knob 123 for manually tightening and loosening the aperture engagement mechanism 120. Other types of aperture engagement mechanisms 120 may be utilized, such as ball-lock pins (not shown) known in the art, clevis pins (not shown), pins with a wire snap safety (not shown), and the like.

Each second pivot mechanism 80 includes a sleeve 130 formed with the perforated square metal tube material 100, the sleeve 130 adapted to fit over and slide along one of the base members 40, such that the position of the front support member 100 may be adjusted along any of the base members 40 and mutually secured with one of the aperture engagement mechanisms 120.

In use, with the base members 40 resting on the support surface 15, the person 20 can adjust: 1) the position of the front members 70 and the front support member 100 along the base members 40, 2) an angle $\alpha$ of the front members 70, 3) an angle $\beta$ of the front support member 100, and 4) an angle $\theta$ of the rear support member 90 while performing exercises.

Figure 5:
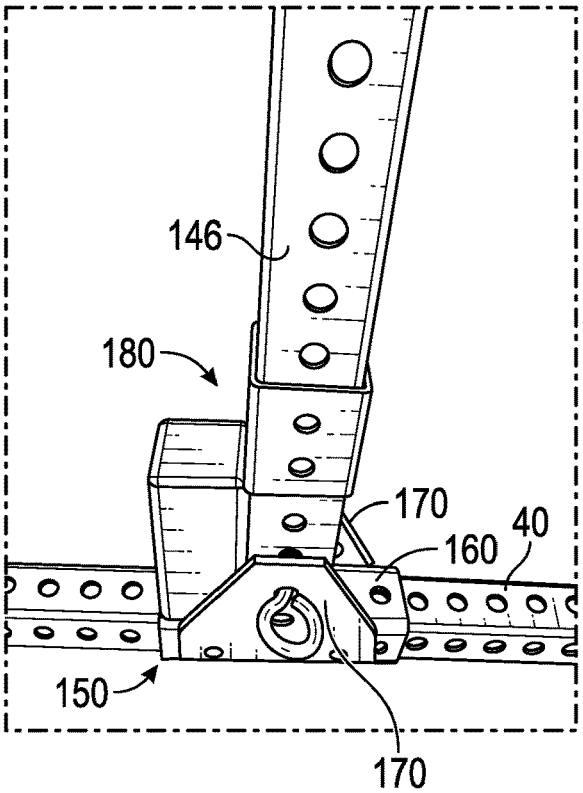
FIG. 5 is a partial, enlarged perspective view of a third pivot mechanism for a barbell support member, illustrating a pivot locking sleeve of the invention.
Figure 6:
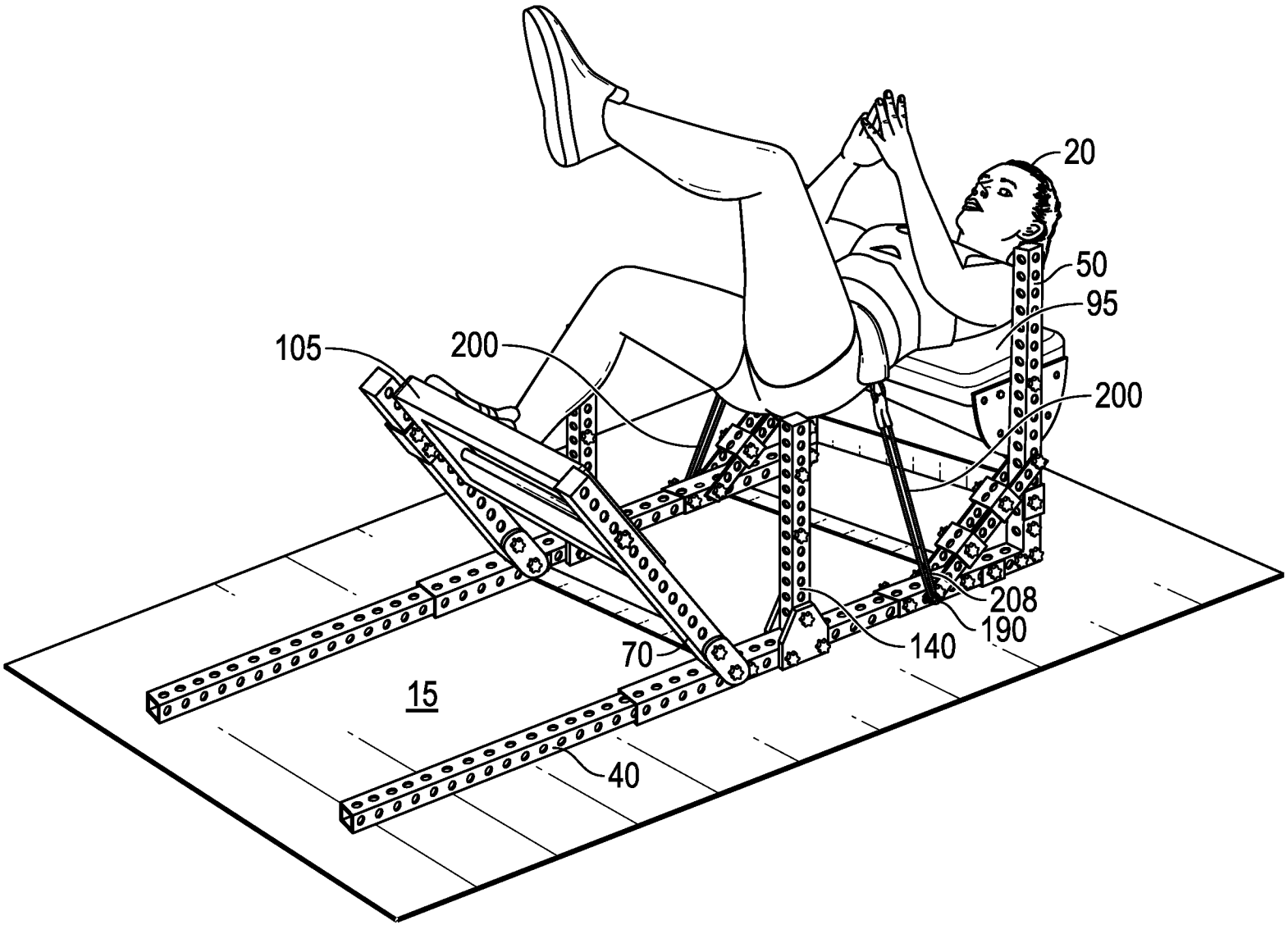
FIG. 6 is an alternate perspective view of the invention, illustrated as used with a pair of resistance bands.
Figure 7A:
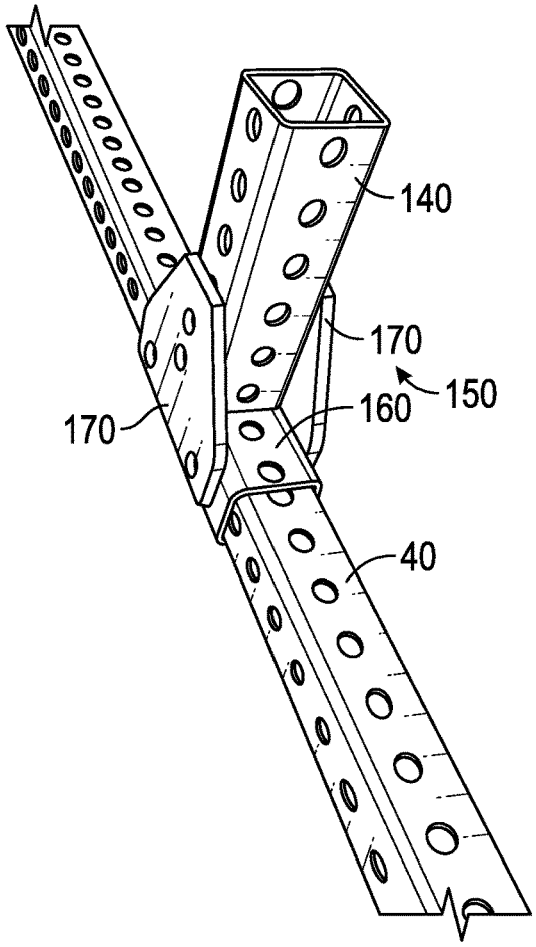
FIG. 7A is a perspective view of one embodiment of the third pivot mechanism.

Preferably the exercise apparatus 10 further includes two barbell support members 140 each formed with the perforated square metal tube material 110. Each barbell support member 140 includes a hook 146 at an upper end 48 thereof, and at a lower end 142 a third-pivot mechanisms 150 that includes a sleeve 160 (FIGS. 5, 7A & 7B) formed with the perforated square metal tube material 110 and adapted to fit over and slide along one of the base members 40 between the rear member 50 and the front member 70. Preferably each hook 146 further includes a locking arrangement 147 for locking the barbell 18 to the barbell support member 140, such as a bolt 121 and nut 122 (FIG. 4), a clamp (not shown), or the like. A relatively flat and rigid cross-member 260 may be fixed between the third pivot mechanisms 150 to provide additional support and stability to the exercise apparatus 10.

Each third pivot mechanism 150 and preferably each first pivot mechanism 60 and second pivot mechanism 80 further includes a pair of riser plates 170 that are adapted for pivotally engaging the lower end 142 of one of the barbell support members 140. A pivot aperture 172 (FIG. 7C) in each riser plate 170 is engaged with one of the aperture engagement mechanisms 120 to rotationally fix each riser plate 170 with the barbell support member 140. Position apertures 174 are located at varying rotational positions from the pivot aperture 172 to allow the barbell support member 140 to be positioned at one of several fixed rotational positions by use of one of the aperture engagement mechanisms 120, the distance between the pivot aperture 172 and each position aperture 174 being identical and aligned with two of the apertures 115 of the perforated square metal tube material 110 of the barbell support member 140. Each pivot mechanism 60,80,150 is preferably made from a rigid metal material, such as steel or iron.

Figure 7B:
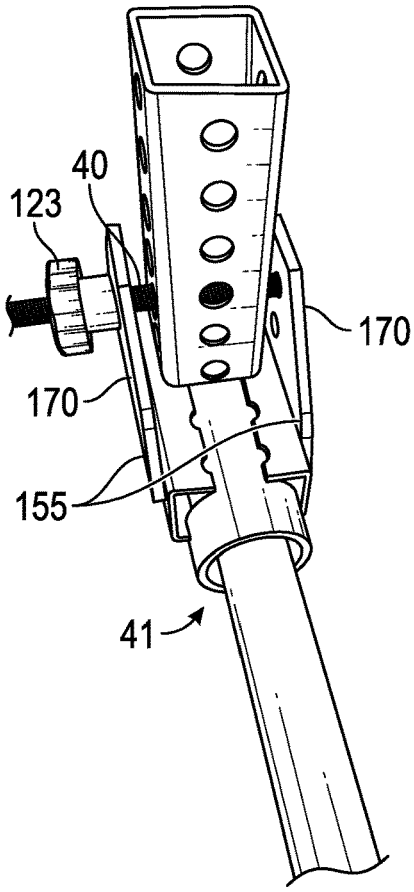
FIG. 7B is a perspective view of an alternate embodiment of the third pivot mechanism.
Figure 7C:
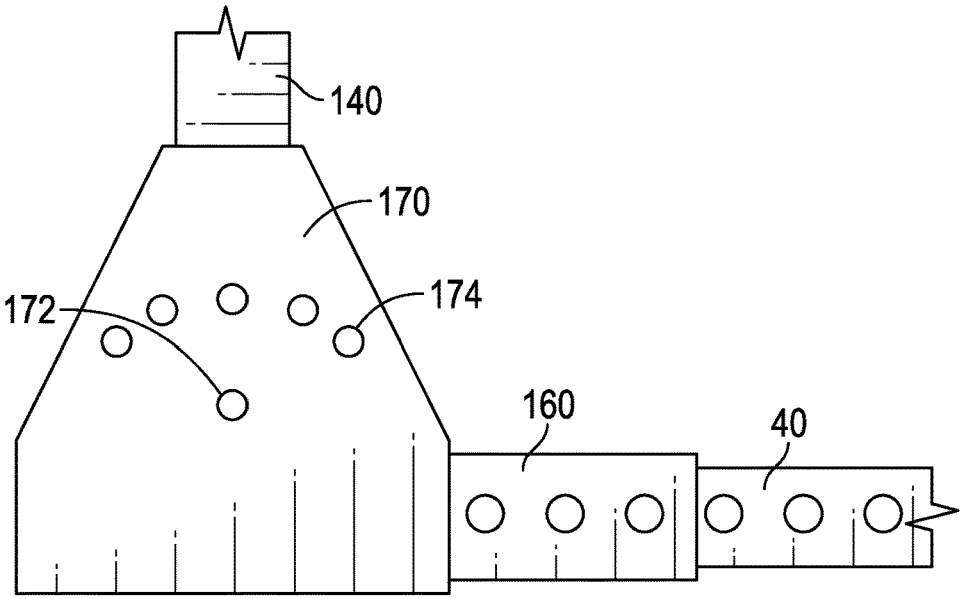
FIG. 7C is a side elevational view of the third pivot mechanism.

In some embodiments, each third pivot mechanism 150 is split along a vertical longitudinal plane to separate the third pivot mechanism 150 into two halves 155 (FIG. 7B). As such, each third pivot mechanism 150 can be slidably retained on one of the base members 40 or can be disassembled, one or more of the aperture engagement mechanisms 120 utilized to clamp each half 155 of the third pivot mechanism 150 around the base member 40 and to retain the rotational position of the barbell support member 140 relative to the third pivot mechanisms 150 and the base member 40. Such a split third pivot mechanism 150 can also be used to secure the perforated square metal tube material 110 with a round or cylindrical object 41, such as the barbell 18 if desired.

Such barbell support members 140 preferably further include a pivot locking sleeve 180 (FIG. 5) that is free to travel along the barbell support member 140 and, when engaged with the third pivoting mechanism 150 at the lower end 142 of the barbell support member 140, engages the third pivoting mechanism 150 to prevent the barbell support member 140 from pivoting with respect to the third pivoting mechanism 150 or the base member 40, thereby rotationally locking the barbell support member 140 into a vertical position when the support surface 15 is horizontal. Such a pivot locking sleeve 180 may be used in place of, or in addition to, the position apertures 174 of the riser plates 170 and the aperture engagement mechanisms 120.

As such, each of the two barbell support members 140 can be fixed upright with one of the third pivot mechanisms 150, both of the third pivot mechanisms 150 being mutually aligned on each base member 40, such that the barbell 18 can be supported on the hooks 146 of the upper end 148 of the barbell support members 140. One or more of the aperture engagement mechanisms 120 locks each of the third pivot mechanisms 150 with the base member 40.

Figure 9:
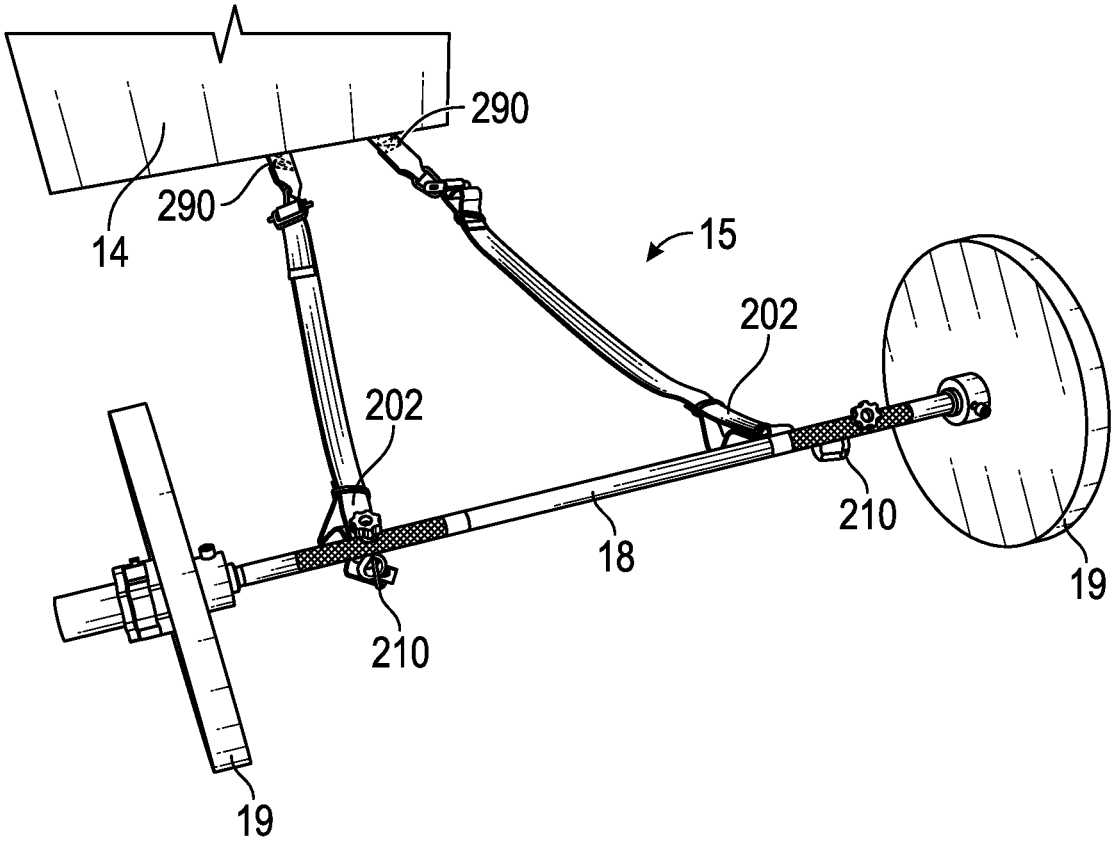
FIG. 9 is a perspective view of the invention, illustrated as used with the barbell being fixed with the resistance bands.

In preferred embodiments of the invention, at least one resistance band anchor 190 (FIG. 9) is further included and fixable through any of the opposing apertures 115 of the base members 40, rear members 50 or forward members 70. Such a resistance band anchor 190 includes a rigid ring 191 through which a distal end 208 of a resistance band 200 may be fixed, either directly or with a hook, carabiner, or the like. Such a resistance band 200 may include a resistance band loop 204 fixed with the resistance band anchor 190 that is adapted to be fixed in any of the opposing apertures 115 of any of the rear members 60, base members 40, or front members 70.

Figure 10:
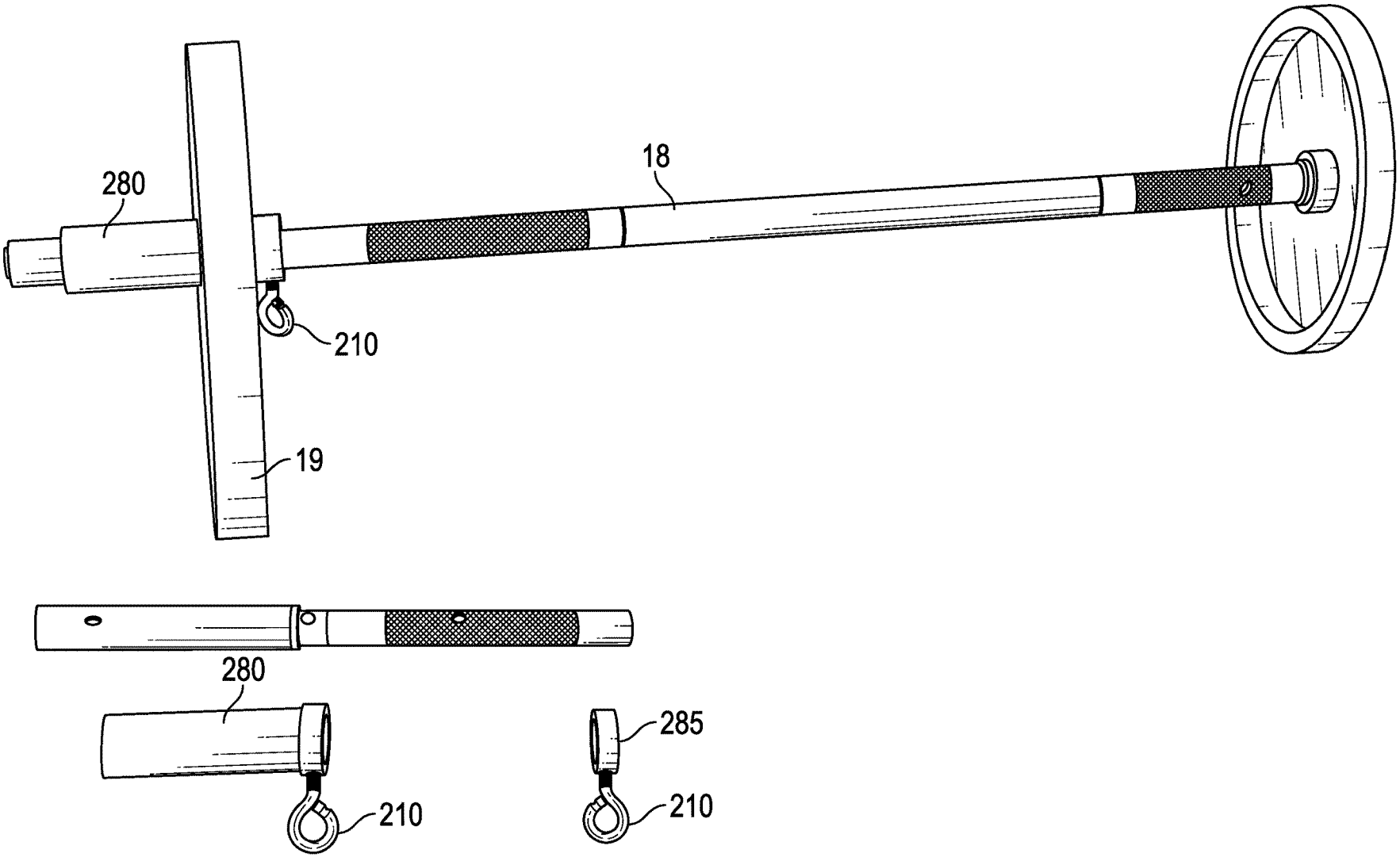
FIG. 10 is a perspective view of the barbell having adapter sleeves and an Olympic-style weight adapter.

In some embodiments the barbell 18 has two opposing resistance band attachment rings 210 fixed therewith. As such, the resistance bands 200 may be fixed at a proximal end 202 thereof to the barbell 18 and at the distal end 208 thereof to the at least one resistance band anchor 210, such that the person 20 can lift the barbell 18 to stretch the resistance bands 200. Alternately, the resistance bands 200 may be fixed at a proximal end 202 thereof to the barbell 18 and at the distal end 208 thereof to the underside of a door 14 or other fixed structure (FIG. 9) with a door hook 290. The barbell 18 may include two adapter sleeves 280 (FIG. 10) each having one of the resistance band attachment rings 210 fixed therewith. In one embodiment the adapter sleeve 280 includes a section for adapting the barbell 18 to accept Olympic-style weights 19, whereas in another embodiment the adapter sleeve 280 is a ring 285 having one of the resistance band attachment rings 210 fixed therewith.

Figure 8:
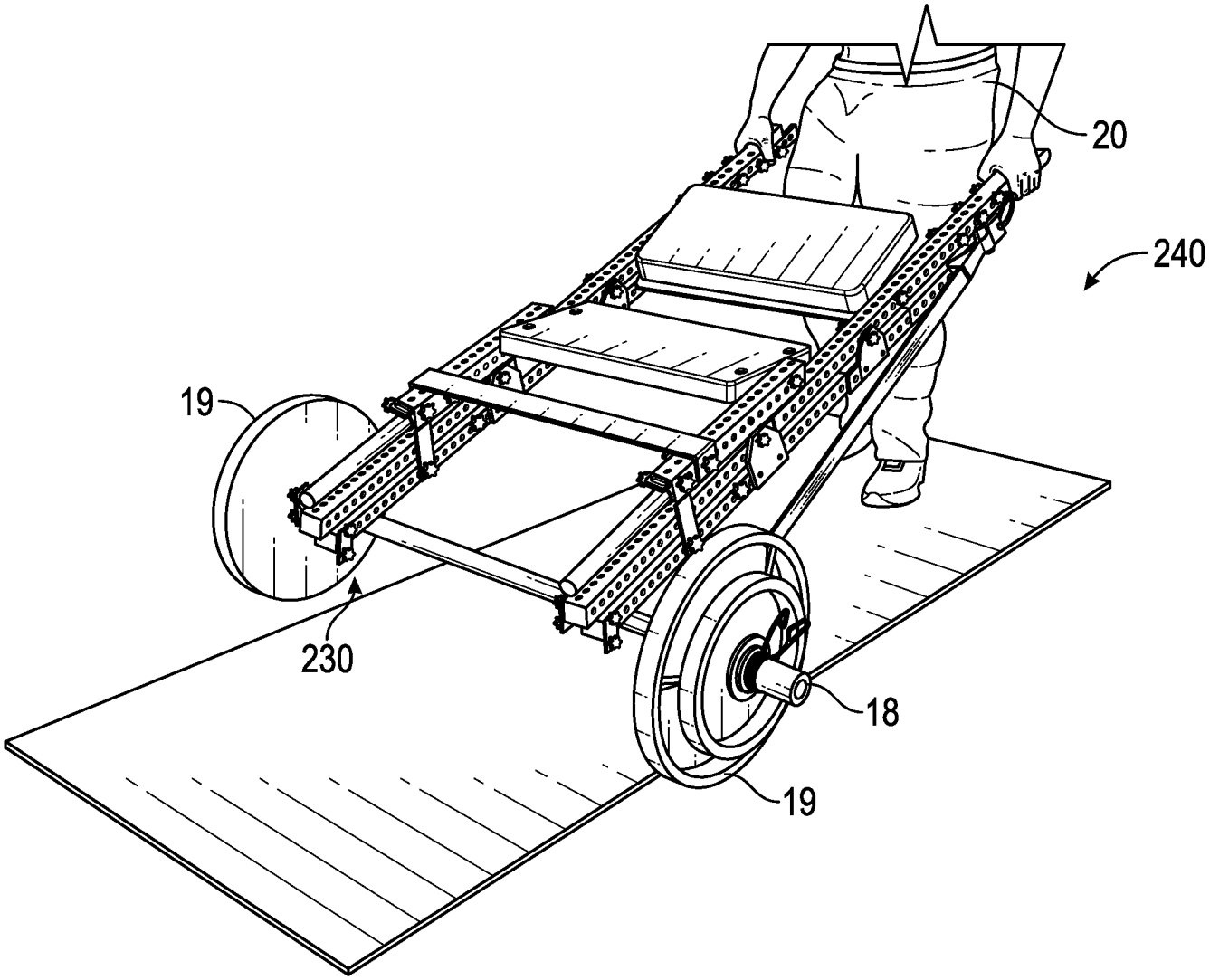
FIG. 8 is a perspective view of the invention, illustrated in a collapsed configuration for rolling along a support surface.

Preferably each rear member 50 includes a barbell lock 230 that is selectively lockable to the barbell 18. As such, the exercise apparatus 10 can be configured into a collapsed configuration 240 (FIG. 8) with the base members 40, rear members 60, and front members 70 collapsed and aligned. With the barbell 18 fixed with the barbell lock 230 and the exercise apparatus 10 in the collapsed configuration 240, the circular weights 19 may be fixed with each end of the barbell 18 to act as wheels while the person grasps and lifts the front sides 42 of the base members 40. The weights 19 may include an elastomeric protective covering 270 around a circumference thereof to minimize damage between contact of the weights 19 and the support surface 15. As such the person 20 is able to wheel the exercise apparatus 10 along the support surface 15. Once positioned at a desired location on the support surface 15, the exercise apparatus 10 may be reconfigured into an expanded configuration 250 for use (FIG. 1).

Figure 11:
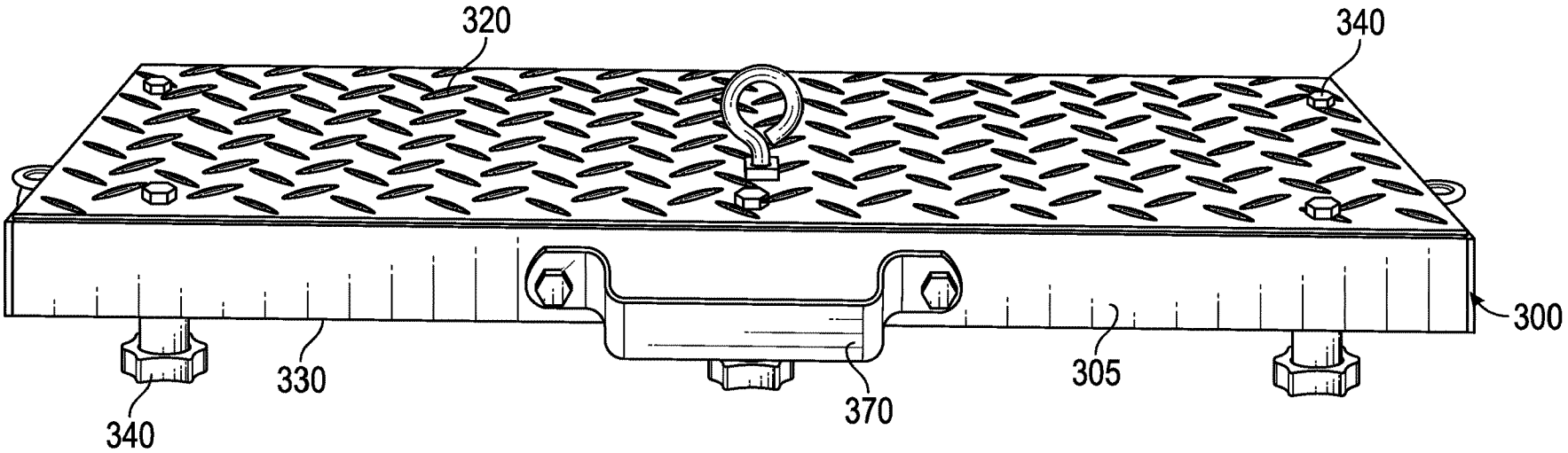
FIG. 11 is a perspective view of a rear support member in a closed configuration.
Figure 12:
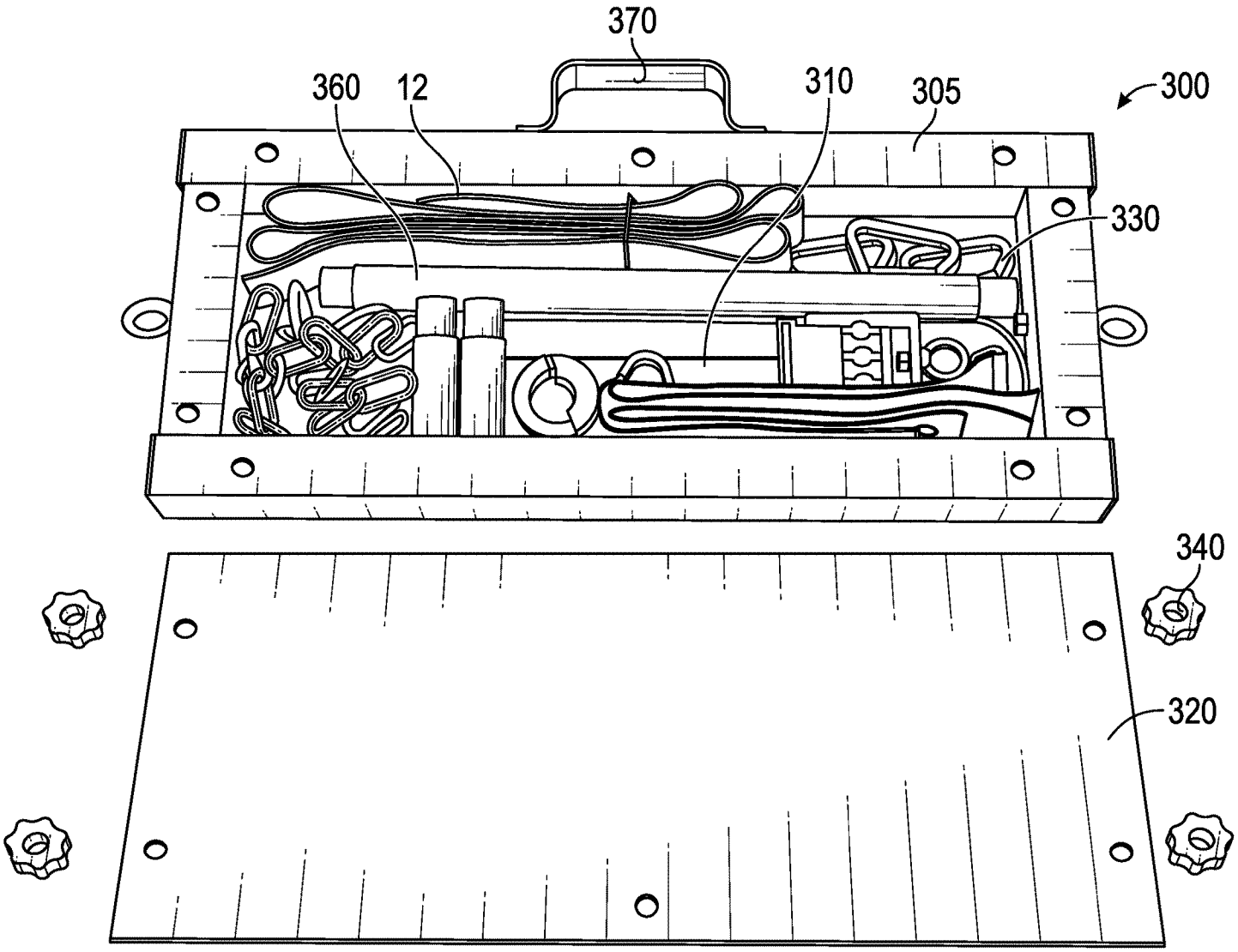
FIG. 12 is a perspective view of the rear support member of FIG. 11 in an open position with a front cover removed to reveal an internal volume for storing exercise items.
Figure 13:
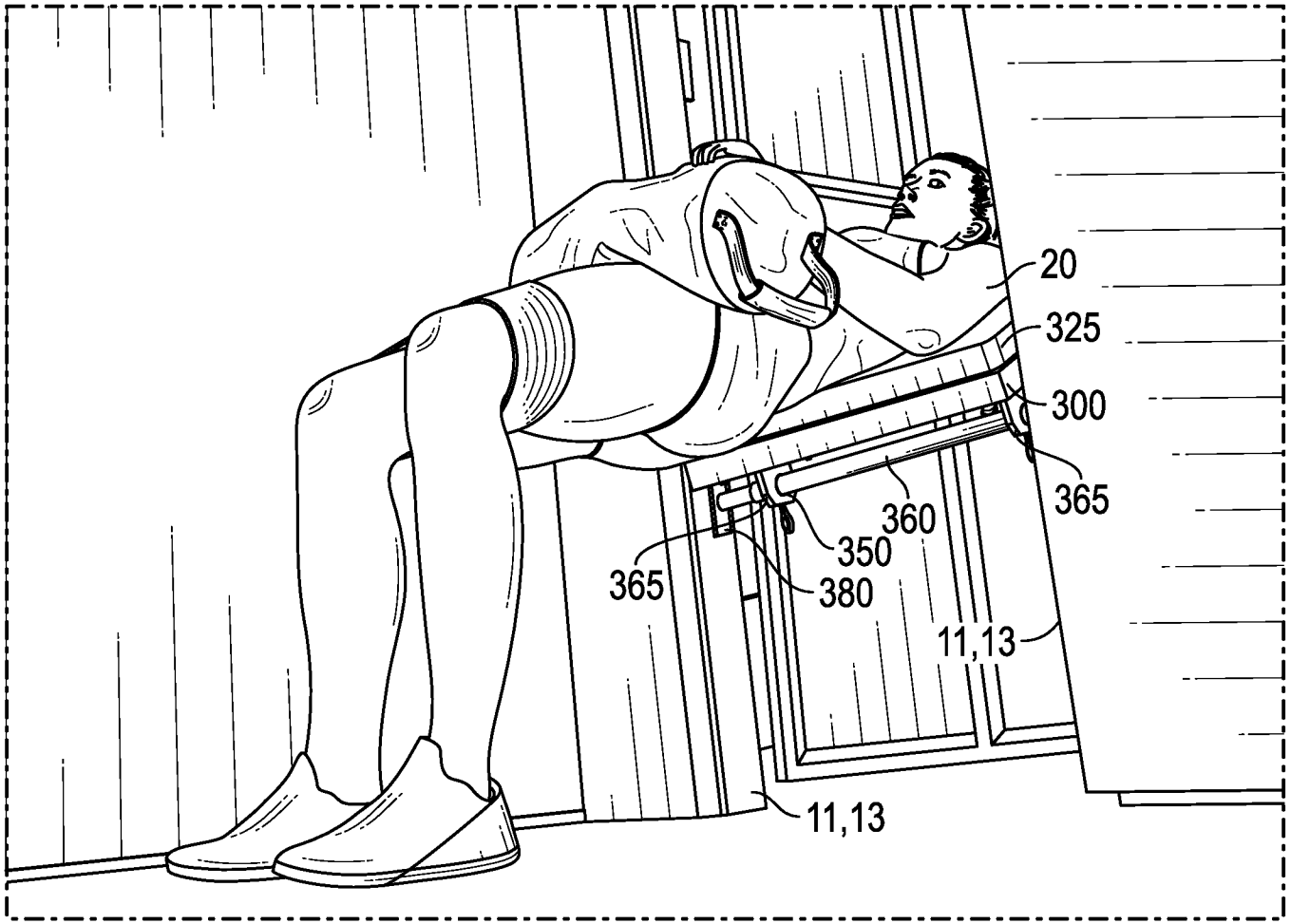
FIG. 13 is a perspective view of a person utilizing the rear support member as attached between two vertical walls of a door frame, the rear support member including a cushioning pad.

FIGS. 11-13 illustrate the rear support member 90 configured for the person 20 to exercise therewith utilizing a support structure 13 such as a vertical wall 11. A frame 300 defines an internal volume suitable between a plurality of frame members 305 for strong exercise items 12. The frame members 305 are preferably made from a rigid metal material. A front cover 320 and a rear cover 330 are both adapted for fixing with the frame 300 with a plurality of mechanical fasteners 340 that are fixed through the frame members 305. A handle 370 may be fixed with the frame 300, such that the person 20 can carry the rear support member 90 by the handle 370. A cushioning pad 325 may be included for attaching with the frame 300 or the front cover 320 for comfort.

Two or more support bar mounts 365 (FIG. 13) are fixable to the rear cover 330 and have apertures 350 therein for rotationally connecting with one or more support bars 360 attached with the support structure 13. The one or more support bars 360 terminate at a wall mounting bracket 380, whereby the rear support member 90 may be fixed between two vertical walls 11 as the support structure 13. Alternately, the one or more support bars 360 terminate at pivot mounts 390, whereby the rear support member 90 may be fixed between two rear members 50 (FIG. 2) as the support structure 13.

Figure 14:
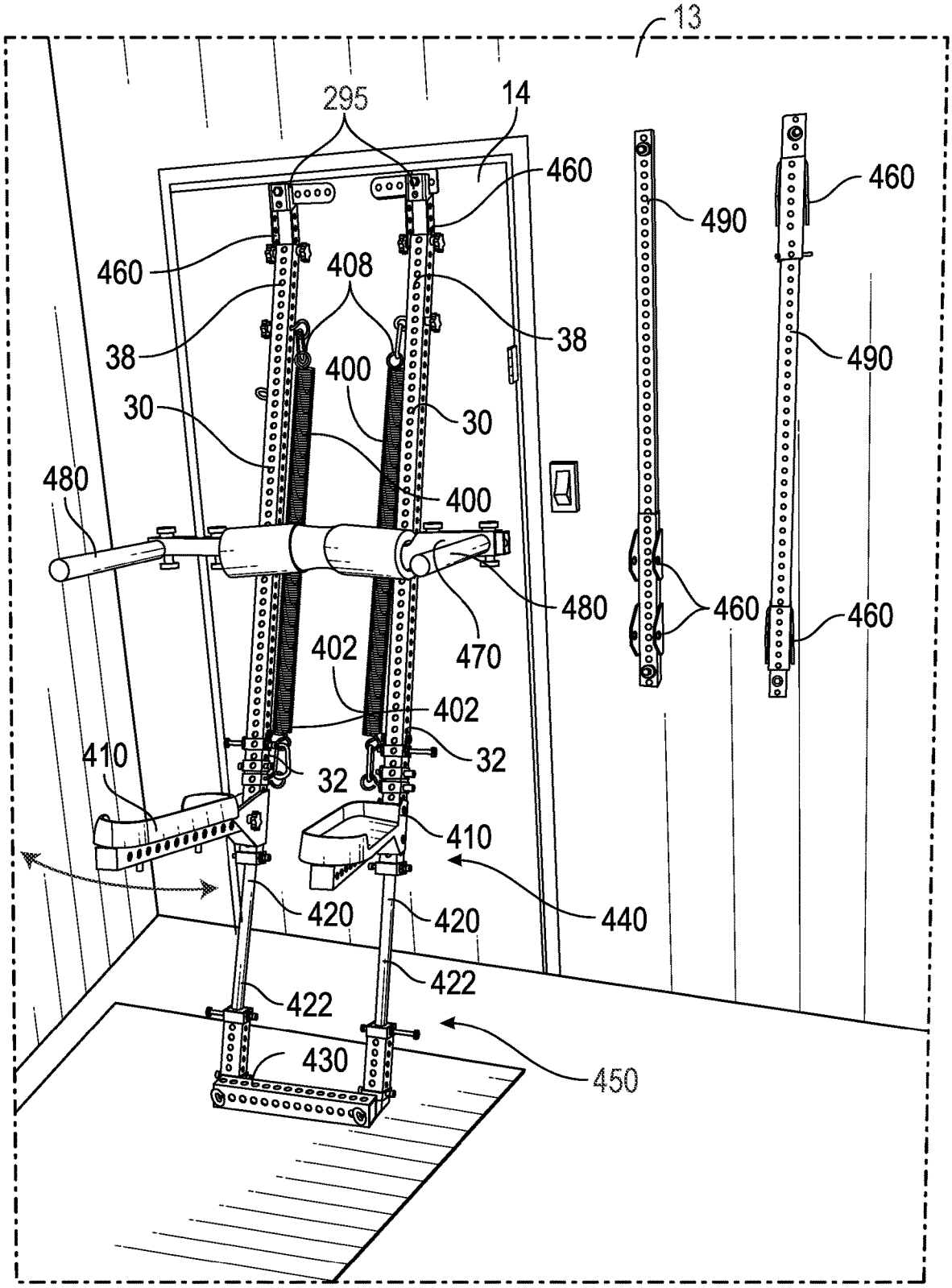
FIG. 14 is a perspective view of an alternate exercising apparatus having spring-biased foot pedal assemblies rotatably mounted to cylindrical guide posts, and supported by both horizontal and vertical support surfaces.

In another embodiment (FIG. 14), the exercise apparatus 10 includes the two side frames 30 each terminating at a lower end 32 and an upper end 38 and being formed with the perforated square metal tube material 110 having the plurality of longitudinally-aligned equally-spaced apertures 115 formed along each side 114 thereof.

Each side frame 30 includes a spring 400 fixed at an upper end 408 thereof to one of the apertures 115 of the side frame 30 and terminating at a lower end 402 with a foot pedal assembly 410. Each side frame 30 includes at the lower end 402 thereof a guide pot 420, the foot pedal assembly 410 slidably affixed to the guide post 420. A lower end 422 of the guide post 420 is fixed with a cross bar assembly 430 supported on the horizontal support surface 15. Each foot pedal assembly 410 is slidable between a raised position 440 and a lowered position 450. The guide post 420 is preferably cylindrical such that the foot pedal assembly 410 is free to rotate around the guide post 420. Each side frame 30 further includes at the upper end 38 thereof a vertical support mount 460 adapted for fixing with the vertical support 13, such as the wall 11 or the door 14.

A handlebar arrangement 470 is fixed with each of the side frames 30 and include two handlebars 480 projecting away from the vertical support surface 13 between the upper end 38 and the lower end 32 of each side frame 30. As such, with the person 20 standing on each of the foot pedal assemblies 410, the person can grasp the handlebars 480 and press the foot pedal assemblies 410 downward to expand the coil springs 400 to perform exercises.

In some embodiments, the vertical support mounts 460 terminate at the door hook 290 for supporting the exercise device 10 on the door 14. In other embodiments, a pair of wall mount members 490 are fixed with the vertical support surface 13, each wall mount member 490 being formed from the perforated square metal tube material 110 having the plurality of longitudinally-aligned equally-spaced apertures 115 formed along each side 114 thereof. The vertical support mounts 460 are adapted to be selectively fixed with the wall mount members 490 at any of the apertures 115 of the wall mount members 490 so as to provide for a vertical adjustment of a height of the upper ends 38 of the side frames 30. The angle of the side frames 30 with respect to the vertical support surface 13 is also adjusted thereby, typically with the removable and selectively attachable aperture engagement mechanisms 120.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the 16 invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A rear support member for a user to exercise utilizing a support structure, the rear support member comprising:

a frame defining an internal volume between a plurality of frame members;

a front cover and a rear cover both adapted for fixing with the frame with a plurality of mechanical fasteners that are fixed through the frame members, wherein the front cover and the rear cover, when fixed with the frame, completely encloses the internal volume;

two or more support bar mounts fixable to the rear cover and having apertures therein for rotationally connecting with one or more support bars attached with the support structure, the one or more support bars spanning from one side to the other side of the frame, extending beyond each of the two or more support bar mounts at opposing sides of the structure to engage with the support structure; and wall mounting brackets, wherein the one or more support bars terminate at the wall mounting brackets, whereby the rear support member is configured to be fixed between two vertical walls as the support structure and one of the one or more support bars are operable to be pivotably disposed in the wall mounting brackets;

whereby exercise items are stored within the internal volume of the rear support member, and whereby the rear support member is configured to be fixed with the support structure through the support bars to provide a rotatable support surface for the user to perform exercises.

2. The rear support member of claim 1, further including a handle fixed with the frame, whereby the user may carry the rear support member by the handle.

3. The rear support member of claim 1, further including a cushioning pad adapted for fixing with the front cover and/or frame.

4. The rear support member of claim 1, wherein exercise items are stored within the internal volume of the rear support member when either the front cover or the rear cover is temporarily removed.

5. A rear support member for a user to exercise utilizing a support structure, the rear support member comprising:

a frame defining an internal volume between a plurality of frame members;

a front cover and a rear cover both adapted for fixing with the frame with a plurality of mechanical fasteners that are fixed through the frame members, wherein the front cover and the rear cover, when fixed with the frame, completely encloses the internal volume;

two or more support bar mounts fixable to the rear cover and having apertures therein for rotationally connecting with one or more support bars attached with the support structure, the one or more support bars spanning from one side to the other side of the frame, extending beyond each of the two or more support bar mounts at opposing sides of the structure to engage with the support structure;

wherein the one or more support bars terminate at pivot mounts, whereby the rear support member is configured to be fixed between two rear members as the support structure;

whereby exercise items are stored within the internal volume of the rear support member, and whereby the rear support member is configured to be fixed with the support structure through the support bars to provide a rotatable support surface for the user to perform exercises.

6. The rear support member of claim 5, further including a handle fixed with the frame, whereby the user may carry the rear support member by the handle.

7. The rear support member of claim 5, further including a cushioning pad adapted for fixing with the front cover and/or frame.

8. The rear support member of claim 5, wherein exercise items may be stored within the internal volume of the rear support member when either the front cover or the rear cover is temporarily removed.

* * * * *